US007800601B2

(12) United States Patent
Miura

(10) Patent No.: US 7,800,601 B2
(45) Date of Patent: Sep. 21, 2010

(54) DISPLAY CONTROL METHOD AND APPARATUS

(75) Inventor: Makoto Miura, Yamagata (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 679 days.

(21) Appl. No.: 11/819,293

(22) Filed: Jun. 26, 2007

(65) Prior Publication Data

US 2008/0001941 A1 Jan. 3, 2008

(30) Foreign Application Priority Data

Jul. 3, 2006 (JP) ..... 2006-183655

(51) Int. Cl.
*G09G 5/00* (2006.01)

(52) U.S. Cl. ..... 345/204; 345/211; 345/98; 345/100; 345/208

(58) Field of Classification Search ..... 345/60–103, 345/204, 211–213, 208–210
See application file for complete search history.

(56) References Cited

U.S. PATENT DOCUMENTS 6,549,186 B1 4/2003 Kwon
6,573,881 B1 6/2003 Kwon
6,795,047 B2 9/2004 Kudo et al.
7,084,852 B2 8/2006 Nahi et al.
2003/0174119 A1 9/2003 Nishi et al.
2006/0232542 A1 10/2006 Nishi et al.

FOREIGN PATENT DOCUMENTS

CN 1444201 A 9/2003
JP 2001-22329 1/2001
JP 2002-244622 8/2002
JP 2003-271105 9/2003
JP 2004-163912 A 6/2004

OTHER PUBLICATIONS

Japanese translation of a Chinese Office Action dated Mar. 25, 2010 with an English translation.

*Primary Examiner*—Lun-Yi Lao
(74) *Attorney, Agent, or Firm*—McGinn IP Law Group, PLLC

(57) ABSTRACT

Disclosed is a display controlling apparatus including latch circuits for holding color data of a current line and a previous line, a latch circuit for holding a polarity signal of the previous line, and a recovery control circuit. The recovery control circuit controls a recovery switch from color data of the previous and current lines, a polarity signal and a recovery clock. For both driving method employing frame-based common inverting and the driving method employing line-based common inverting, the display/controlling apparatus recovers electric charge efficiently to provide for low power dissipation.

14 Claims, 13 Drawing Sheets

*LINE-BASED COMMON REVERSAL DRIVING

DISPLAY CONTROL METHOD AND APPARATUS

FIELD OF THE INVENTION

This invention relates to a display control circuit and a method for driving/ controlling the circuit.

BACKGROUND OF THE INVENTION

Ultra-low power dissipation is required of a driver IC for a mobile display, such as a mobile telephone terminal. In actual application, such mobile display is mostly in idle mode. Hence, a demand for reducing the power dissipation in such idle mode is stringent.

In mobile displays, in the idle mode, image is not displayed with full-color mode (full grayscale display with preset plural bits each for R, G and B) but with eight-color mode (display with one bit each for R, G and G). In the eight-color display mode, a source driver that drives a source line, is not an analog buffer, but a buffer using an inverter which drives a source line based on 1-bit data for each of R, G and B color data. In case the buffer used is a non-inverting buffer, it is made up of two cascaded inverters.

In Patent Document 1, there is disclosed a TFT-LCD and a method for driving the device through multi-stage charge re-utilization as the configuration for reducing power dissipation of a display. This TFT-LCD includes a recovering capacitor (external capacitor) connected between a source driver (source driving unit) and a liquid crystal panel. The capacitor operates for recovering electric charge on a source line which is at a higher voltage than that of a common electrode when it is connected to the source line connection and for supplying charge to a source line which is at a lower voltage than that of the common electrode. The TFT-LCD further reduces the power dissipation in accordance with a driving scheme which is based on re-utilization of pre-existing charge.

FIG. 10 is a diagram illustration the configuration of the invention disclosed in Patent Document 1. It should be noted that FIG. 10 is a re-formulation by the present inventor of the drawing of Patent Document 1 for ease in understanding its technical contents. Referring to FIG. 10, showing eight-color display for the idle mode, with two values by one-bit data for each of R, G and B, a source buffer (source driver) 108, driving a source line, is not an analog buffer, but a tri-state buffer, driving the source line based on 1-bit data for each of R, G and B color data. In more detail, the source buffer 108 is a tri-state buffer made up of an initial-stage buffer and an inverter having its output enable/disable controlled by a recovery clock 105. When the recovery clock 105 is on, such as HIGH in level, an output of the source buffer 108 is in HI-Z state (in a high impedance state), while a recovery switch 110 is turned on to store electric charge on the source line in a recovery capacitor 112. When the recovery clock 105 is then turned off, such as LOW in level, the recovery switch 110 is turned off to set an output enable state of the source buffer 108 to charge the source line from the source buffer 108. In FIG. 10, the part shown above pads 113 is for a display controller, also called a display control driver or a control IC, and the part shown below the pads 113 is for a display panel (LCD panel). The capacitors connecting to the source lines of the display panel are represented by pixel capacitances as equivalent circuits. The source driver (source buffer) and the source line are also referred to as a data driver and a data line, respectively.

FIG. 11 shows the configuration disclosed in Patent Document 2. It should be noted that FIG. 11 represents re-formulation by the present inventor of the drawing of Patent Document 2 for ease in understanding its technical contents.

Referring to FIG. 11, there is provided a COM buffer 118, and the output of the COM buffer 118, as a common electrode, is recovered by the recovery capacitor. In the configuration of FIG. 11, charges on source lines S1 to S3 and on the common electrode are recovered simultaneously. Meanwhile, in the configuration of FIG. 11, a capacitance of the common electrode (COMMON electrode), connecting to a pad 120, is used as a capacitance in which to store recovered electric charge.

FIG. 12 shows the configuration disclosed in Patent Document 3, which comprises a current line data latch circuit for holding color data of the current line, a previous line data latch circuit for holding color data of a previous line, and a switching controller for controlling a recovery switch from the color data of the previous and current lines and from the recovery clock. Regarding the source line SI, a switching controller 541 operates as follows only when the outputs of a current line data latch circuit 551 differ from those of a previous line data latch circuit 451. The switching controller 541 operates: in response to an output of the previous line data latch circuit 451 to turn on a one of switch for high voltage (transfer gate) 411 and a switch for low voltage (transfer gate) 421, while operating in response to an output of the previous line data latch circuit, transferred from the current line data latch circuit 551, to turn on the other of the switch for high voltage (transfer gate) 411 and the switch for low voltage (transfer gate) 421, thereby connecting the source line SI to a capacitor for high voltage (recovery capacitor for high voltage) 431 or a capacitor for low voltage (recovery capacitor for low voltage) 432. In a source line where the applied voltage is changed with time, electric charge are stored or furnished effectively, decreasing the power dissipation. On the other hand, in a source line where the applied voltage remains unchanged, the voltage retained remains unchanged, so that there is no power dissipation when the voltage is next applied.

FIG. 13 is a timing chart for illustrating the operation of the constitution shown in FIG. 12. In displaying an N'th line, a control signal for a pixel switch is activated to connect a source line in a display controller and a source line on a display panel. The source line SI, on which the output of the previous line data latch circuit 451 is "0" and the output of the current line data latch circuit 551 is "1", is connected to the capacitor for low voltage 432, and then connected to the capacitor for high voltage 431, by the HIGH of the recovery clock. A voltage C is then written on the source line S1 by a D/A converter 311. The source line S2, on which the output of a previous line data latch circuit 452 is "1" and the output of a current line data latch circuit 552 is "0", is connected to the capacitor for high voltage 431, and then connected to the capacitor for low voltage 432, by the HIGH of the recovery clock. A voltage C is then written on the source line S2 by a D/A converter 312. In displaying an (N+1)st line, the operation is reversed from that in displaying the N'th line, that is, the source line S1 is changed over from the high voltage to the low voltage, while the source line S2 is changed over from the low voltage to the high voltage. Hence, it is verified, based on color data on the previous and current lines, whether or not recovery is to be made, in order to control the recovery operation.

[Patent Document 1]

Japanese Patent Kokai Publication No. JP-P2001-22329A

[Patent Document 2]

Japanese Patent Kokai Publication No. JP-P2002-244622A

[Patent Document 3]

Japanese Patent Kokai Publication No. JP-P2003-271105A

SUMMARY OF THE DISCLOSURE

In the related art, described above, the desired charge recovery efficiency may be achieved in case common inverting driving is not used, or in case common inverting driving is from one frame to the next. However, if, in the above related art, in which common inverting driving is from one line to the next, a decision on recovery is given based only on data, the current may be increased, depending on data. In short, in the above related art, sufficient recovery effect may no be expected in dependence upon a driving method used.

The invention disclosed in the present application may be summarized substantially as follows.

In accordance with one aspect of t2he present invention, there is provided a display control apparatus comprising a recovery switch for controlling connection and non-connection between an output node of a buffer which outputs data to a pixel on a display panel, and a capacitor for recovery of charge, and means for on/off controlling the recovery switch based on data and a polarity signal of a current line and data and a polarity signal of a previous line.

In the present invention, the display control apparatus may further comprise a recovery switch controlled on/off by a control signal and connecting a source line to the recovery capacitor when the switch is on, a circuit for holding data of a current line, data of a previous line and a polarity signal of the previous line, and a recovery control circuit for generating and outputting the control signal on/off controlling the recovery switch, based on the combination of the data of the current line, data of the previous line, a polarity signal of the previous line, a polarity signal of the current line and the value of a recovery clock received.

In the present invention, the recovery control circuit determines the change in the previous data and the current data using an upper order bit or bits of the data.

In the present invention, the previous data and the current data are 1-bit data for each of R, G and B colors.

In the present invention, the recovery control circuit may determine the change in the previous data and the current data using 1-bit data.

The display control apparatus according to the present invention may further comprise another recovery switch for on/off controlling the connection between an output of a buffer, driving a common electrode of a display panel, and the recovery capacitor, based on another input recovery clock.

The display control apparatus according to the present invention may further comprise a source buffer driving the source line. This source buffer may include a tristate buffer which, based on a control signal from the recovery control circuit, has an output set to a high impedance state when the recovery switch is on, while having the output set to an output enable state when the recovery switch is off.

In the present invention, the recovery control circuit may include first to fourth logic circuits. The first logic circuit receives data of the previous line and data of the current line, and outputs a first value responsive to coincidence between the data of the previous line and the data of the current line, while outputting a second value responsive to non-coincidence between the data of the previous line and the data of the current line. The second logic circuit receives a polarity signal of the previous line and a polarity signal of the current line, outputs a first value responsive to coincidence between the polarity signal of the previous line and the polarity signal of the current line, and outputs a second value responsive to non-coincidence between the polarity signal of the previous line and the polarity signal of the current line. The third logic circuit receives an output of the first logic circuit and an output of the second logic circuit, outputs a first value responsive to coincidence between outputs of the first and second logic circuits, outputs a second value responsive to non-coincidence between the outputs of the first and second logic circuits. The fourth logic circuit receives the recovery clock and an output of the third logic circuit and outputs the recovery clock as the control signal when an output of the third logic circuit is of the second value.

In another aspect, the present invention provides a driving/controlling method for on/off controlling the connection between an output node of a driver and a capacitor for charge recovery, based on data on a current line and a previous line, and on a polarity signal.

The method according to the present invention is a driving/controlling method for on/off controlling a recovery switch to recovers charge on a data line. The recovery switch controls the connection between a source line connecting to pixels on a display panel and a recovery capacitor. The method includes holding data of a current line, data of a previous line and a polarity signal of the previous line, and on/off controlling the recovery switch, responsive to the recovery clock, based on the combination of the data of the current line, data of the previous line, the value of the polarity signal of the current line and the value of the polarity signal of the previous line.

The meritorious effects of the present invention are summarized as follows.

According to the present invention, electric charge may be recovered efficiently to provide for low power dissipation. According to the present invention, efficient charge recovery may be achieved regardless of the driving method used.

With applied to a display for a mobile terminal, the present invention contributes to reducing the power dissipation in a standby mode.

Still other features and advantages of the present invention will become readily apparent to those skilled in this art from the following detailed description in conjunction with the accompanying drawings wherein examples of the invention are shown and described, simply by way of illustration of the mode contemplated of carrying out this invention. As will be realized, the invention is capable of other and different examples, and its several details are capable of modifications in various obvious respects, all without departing from the invention. Accordingly, the drawing and description are to be regarded as illustrative in nature, and not as restrictive.

EXAMPLES OF THE INVENTION

The present invention is now described in detail with reference to the drawings.

The present invention is directed to a display/controlling apparatus including latch circuits (101, 102) for holding color data of a current line and a previous line, a latch circuit (103) for holding a polarity signal of the previous line, and a recovery control circuit (109). The recovery control circuit controls a recovery switch (110) based on color data of the previous and current lines, a polarity signal and a recovery clock. The charge recovery operation is controlled based on line-based data change and on the polarity signal to allow for efficient charge recovery, thereby achieving low power dissipation for both the driving method employing frame-based common inverting driving and line-based common inverting driving.

Figure 1:
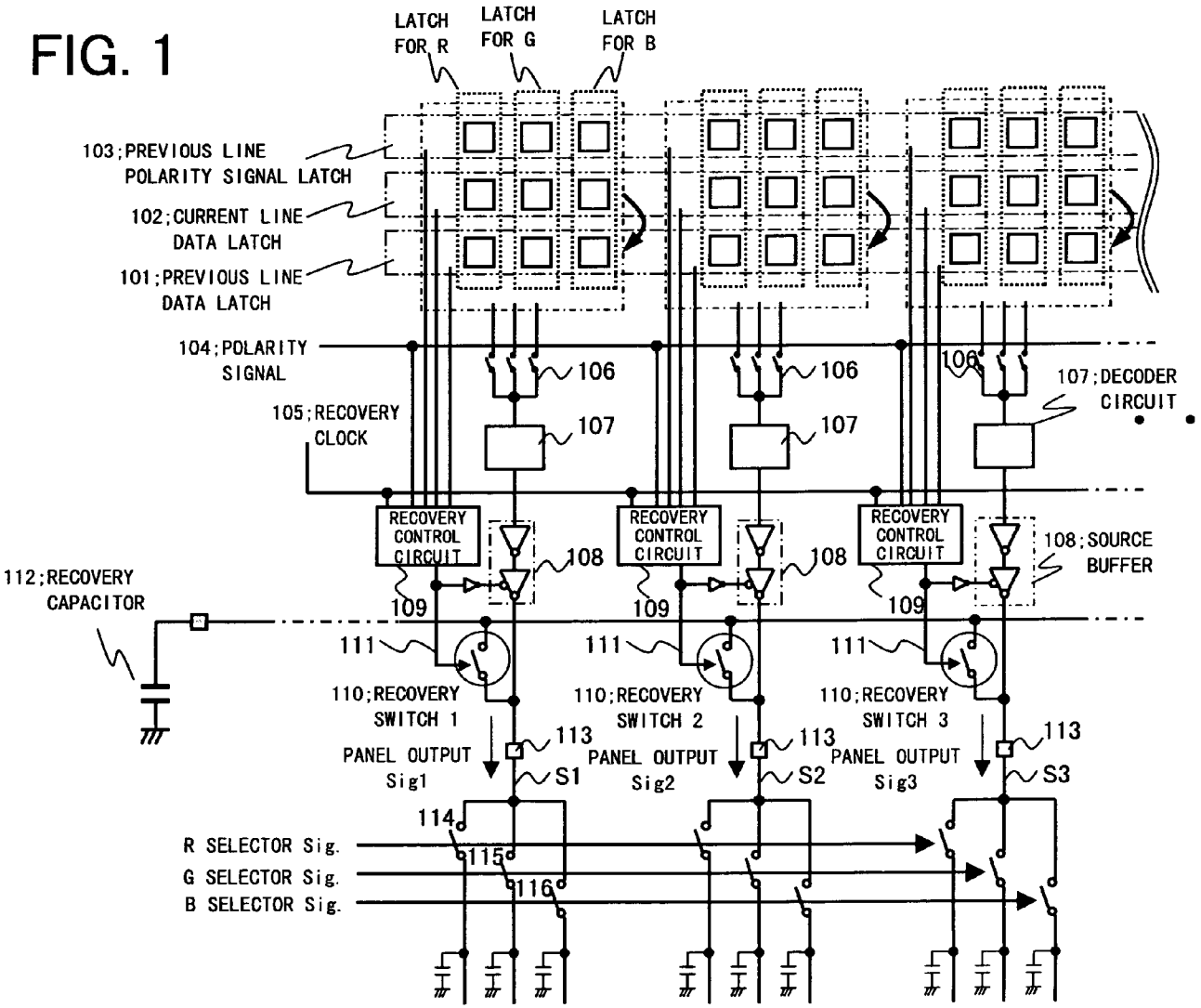
FIG. 1 is a circuit diagram showing an example of the present invention.

FIG. 1 is a diagram illustrating the configuration of an example of the present invention. Referring to FIG. 1, the present example includes: a previous line data latch 101 that latches data of a previous line; a current line data latch 102 that latches data of a current line; and a previous line polarity signal latch 103 that latches a polarity signal of the previous line. The present example also includes a changeover switch 106 that switches between a latch for R, a latch for G and a latch for B of the current line data latch 102 and outputs latched data of the selected latch; a decoder 107 that decodes an output of the changeover switch 106; and a source buffer (source driver) 108 that receives an output (1-bit data) of the decoder 107. The present example also includes a recovery control circuit 109 that outputs from the recovery clock 105, a control signal 111 for on/off controlling the recovery switch 110; and a recovery capacitor 112. The recovery switch 110 has its one end connected to the recovery capacitor 112, while having its other end connected common to respective source lines (to outputs of the source buffers 108).

In FIG. 1, the part lying above the pads 113 represents a display controller (controller IC) inclusive of a source driver, while the part lying below the pads 113 represents a display panel. Signals R selector Sig, G selector Sig and B selector Sig are supplied from the display controller to turn on switches 114 to 116 to connect the source line of the display controller to R, G and B source lines of the display panel. Pixel switches (TFTs) of the line selected by a gate driver, not shown, are turned on to apply respective data signals of source lines for R, G and B to the pixel electrodes.

Figure 10:
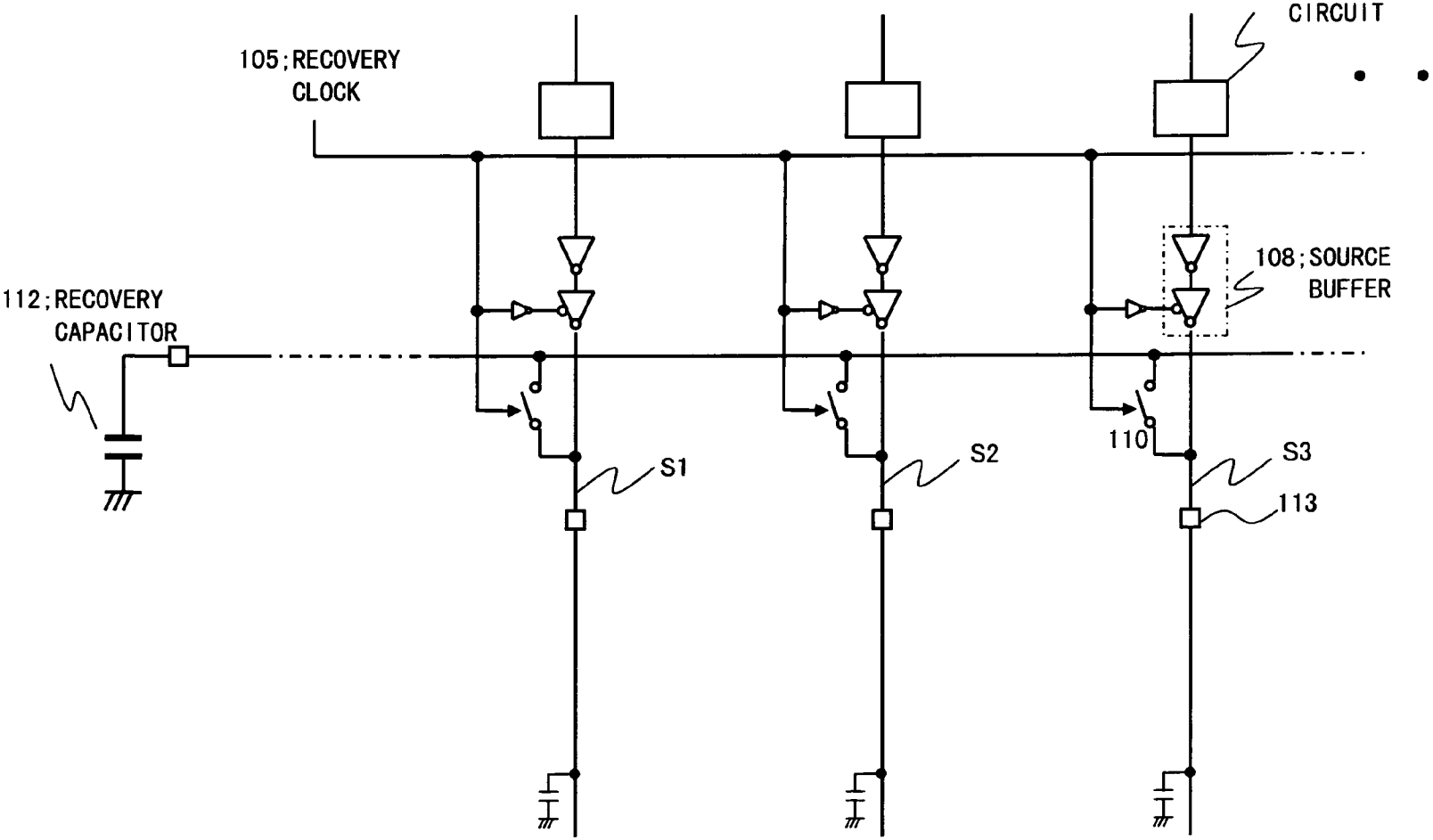
FIG. 10 RELATED ART
FIG. 10 is a circuit diagram showing the configuration of the related art (Patent Document 1).
Figure 11:
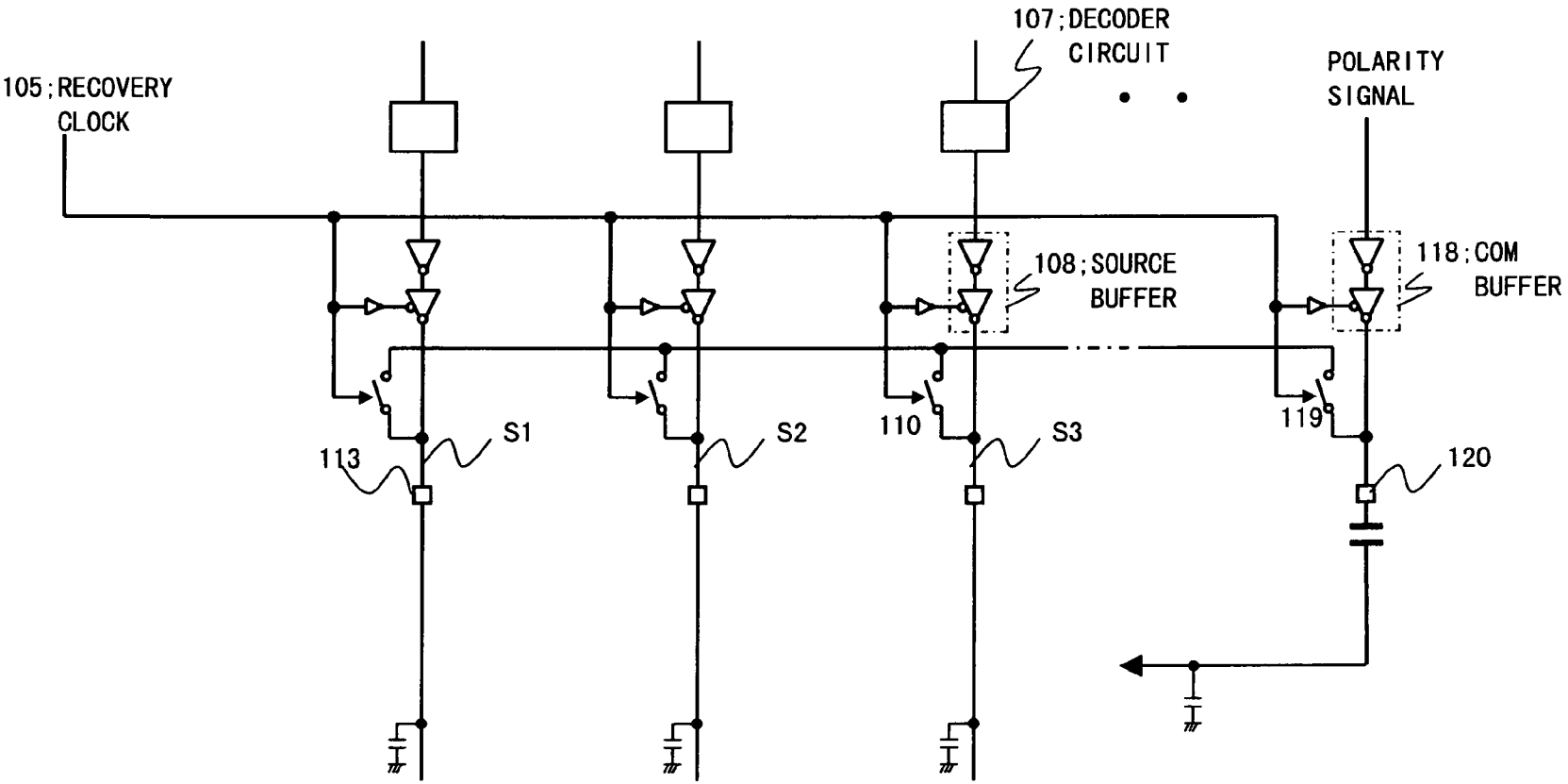
FIG. 11 RELATED ART
FIG. 11 is a circuit diagram showing the configuration of the related art (Patent Document 2).
Figure 12:
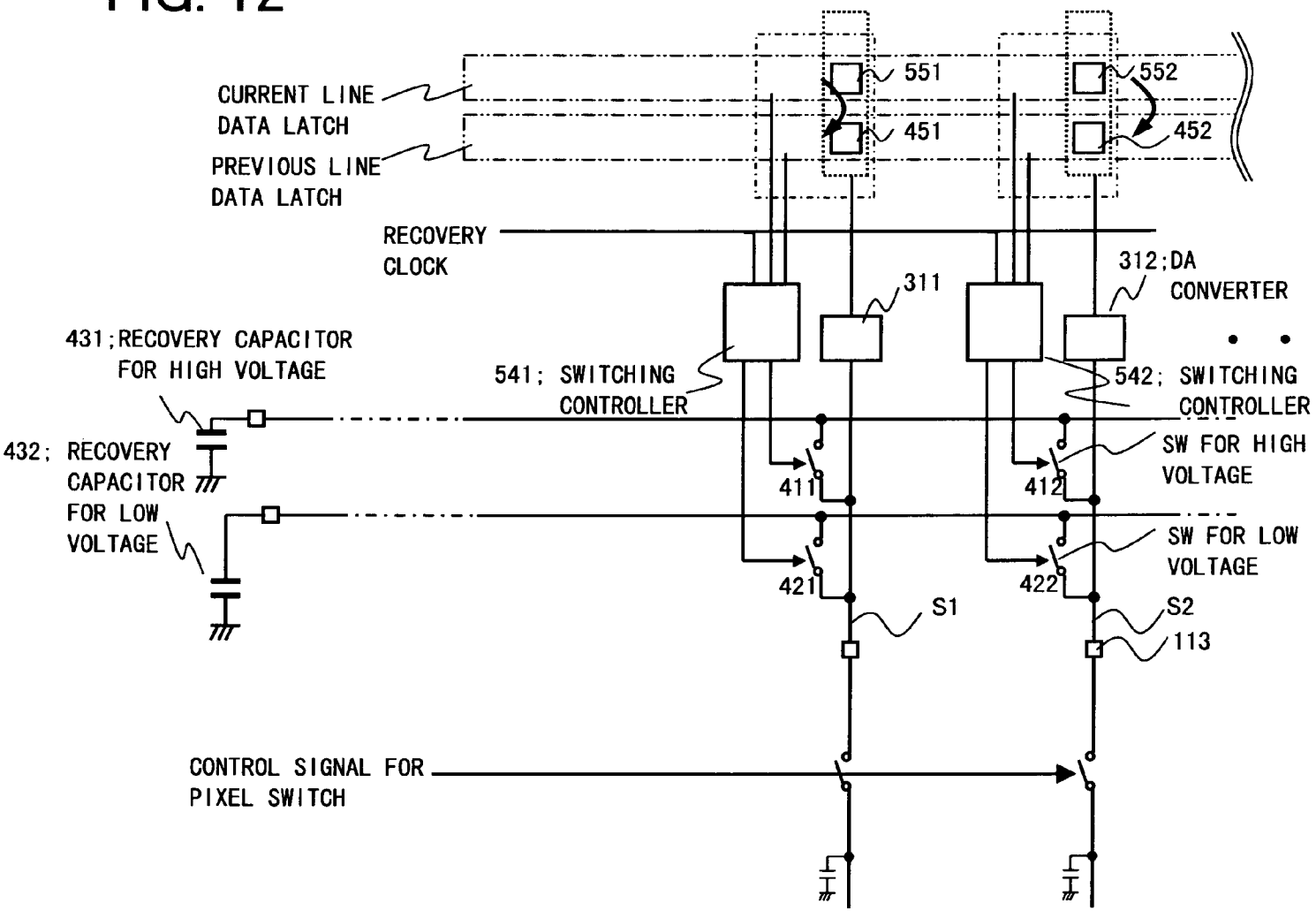
FIG. 12 RELATED ART
FIG. 12 is a circuit diagram showing the configuration of the related art (Patent Document 3).
Figure 13:
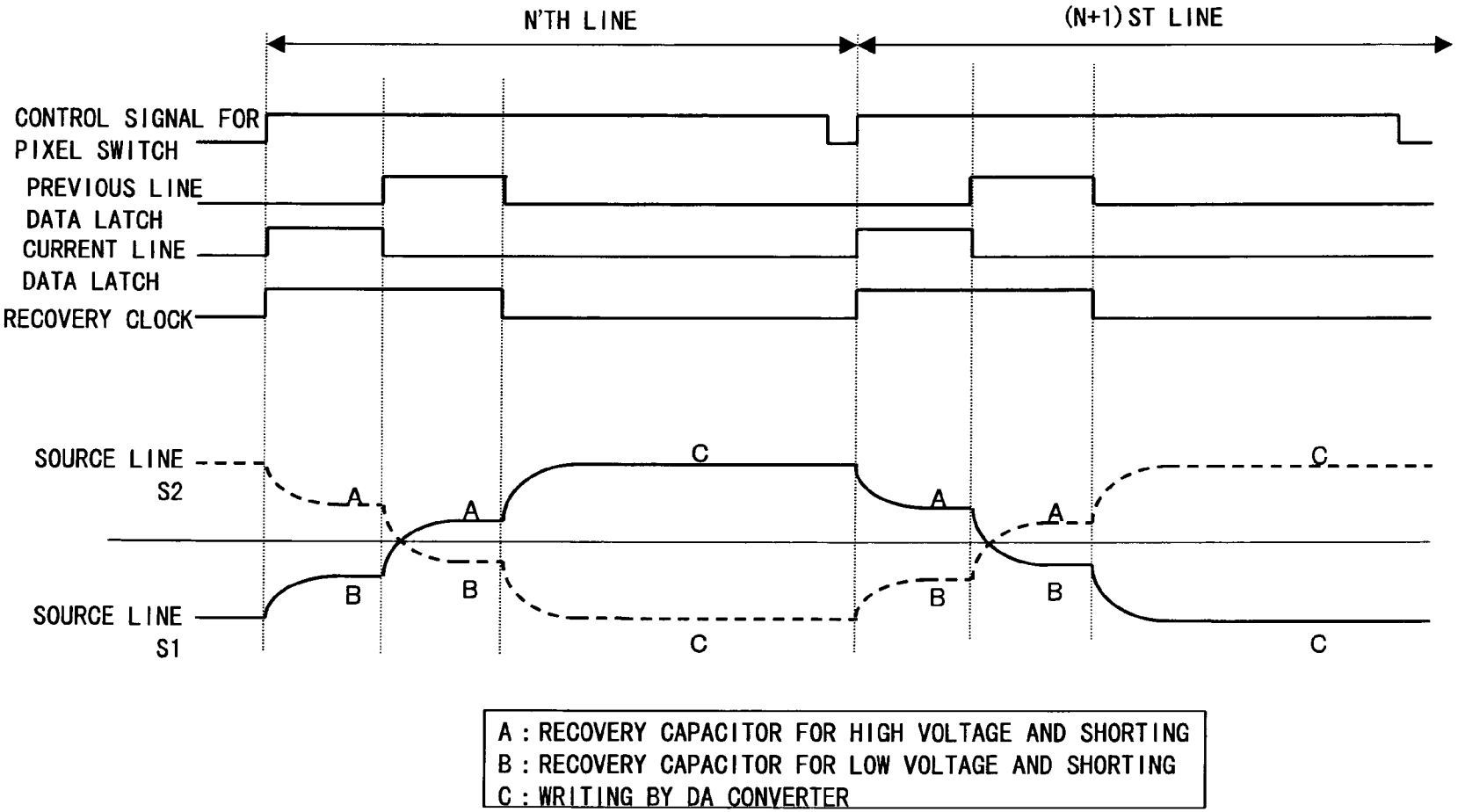
FIG. 13 RELATED ART
FIG. 13 is a timing waveform diagram for illustrating the operation of the related art (Patent Document 3).

In the 8-color display, used for idle mode, such as bi-valued representation by 1-bit data for each of R, G and B, a tristate buffer is used as a source buffer (source driver) 108 for driving a source line. The tristate buffer drives the source line based on 1-bit data for each of R, G and B color data. That is, the source buffer 108 is similar to that used in the configuration of FIG. 10, and is made up of an inverter receiving a bi-valued signal from the decoder 107 and a tristate inverter. However, the tristate buffer in the present example is not directly controlled to an output enable state or to an output disable state (output HI-Z state) by the recovery clock, but by a signal inverted from a control signal 111 from the recovery control circuit 109. When the recovery switch 110 is turned on, the tristate buffer is turned off, with the output being in a HI-Z state, by the control signal 111 from the recovery control circuit 109, managing on/off control of the recovery switch 110, whereas, when the recovery switch 110 is turned on, the tristate buffer is turned on, with the output being in the output enabling state, by the control signal 111.

Figure 2:
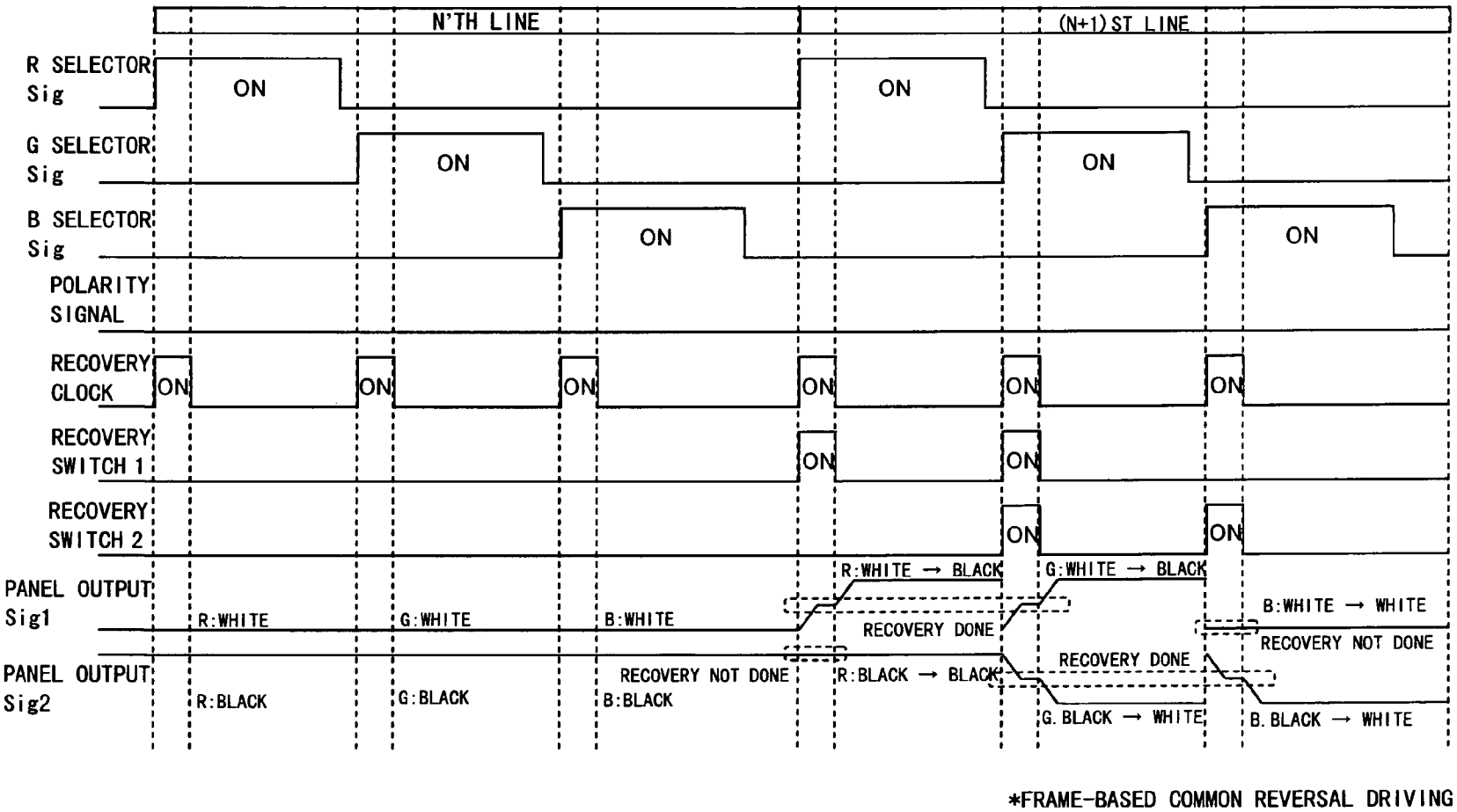
FIG. 2 is a timing waveform diagram for illustrating the operation of the example of the present invention.
Figure 3:
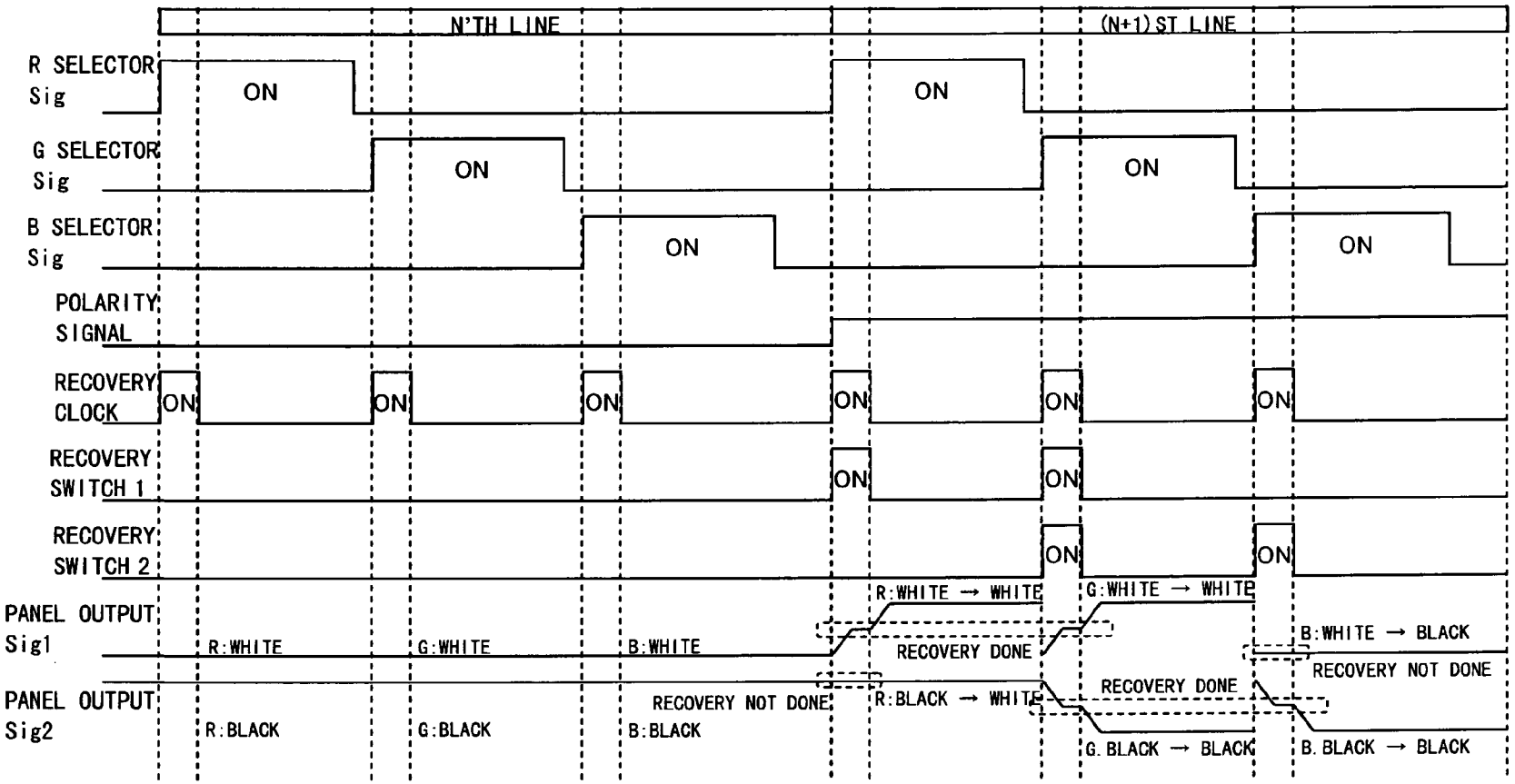
FIG. 3 is a timing waveform diagram, similar to FIG. 2, for illustrating the operation of the example of the present invention.

FIGS. 2 and 3 are timing charts for illustrating the operation of the present example shown in FIG. 1.

It is now assumed that previous polarity signal=LOW, panel output Sig=LOW, white display (data=1);

current polarity signal=LOW, panel output Sig=HIGH, black display (data=0);

previous polarity signal=HIGH, panel output Sig=LOW, black display (data=0);

current polarity signal=HIGH, panel output Sig=HIGH, white display (data=1).

Meanwhile, the panel output Sig is a signal output from the source buffer 108 (signal of pad 113).

FIG. 2 shows a case where common inverting driving is from one frame to the next.

<Change from White to Black>

Referring to FIG. 2, the panel output Sig1(R) is changed in color from white to black in transition from the N'th line to the (N+1)st line. The data line for R has to be charged at this time. Thus, on the (N+1)st line, the recovery switch 1 (recovery switch 110) is transiently turned on when the R selector Sig is on (switch 114 is on) to connect the source line S1 to the recovery capacitor 112 and the panel load is charged from the recovery capacitor (see 'recovery is done' in 'panel output Sig1' of FIG. 2). While the R selector Sig is on, the recovery switch 1 (recovery switch 110) is turned off by the control signal 111 from the recovery control circuit 109 to charge the panel load from the source buffer 108. Meanwhile, as long as the recovery switch I (recovery switch 110) is on, the output of the source buffer 108 of the source line S1 is in a HI-Z state.

<Color Change is from White to White or from Black to Black, Hence there is no Color Change>

In transition from the N'th line to the (N+1)st line, the panel output Sig2 (R) is changed from black to black. Since there is no change in the output voltage, charging/discharge operations are unneeded. Hence, no recovery operation is done in the present example.

<Change from Black to White>

In transition from the N'th line to the (N+1)st line, the panel output Sig2 (G) is changed in color from black to white. At this time, the discharge operation is required. Hence, the recovery switch 2 (recovery switch 110) is transiently turned on to connect the output of the source buffer 108 to the recovery capacitor 112 and the recovery capacitor 112 is charged from the source line S2 (panel load). The recovery switch 2 (recovery switch 110) is turned off by the control signal 111 from the recovery control circuit 109 to turn on and discharge the source buffer 108. Meanwhile, as long as the recovery switch 2 (recovery switch 110) is on, the output of the source buffer 108 of the source line S2 is in a HI-Z state.

With the present example, described above, the recovery efficiency may be improved by turning the recovery switch on only when change is from white (data=1) to black (data=0) or from black (data=0) to white (data=1), for a driving method in which frame-based common inverting driving is executed, in which the polarity is not changed, that is, the value of a polarity signal is not changed, from one line to the next.

Referring to FIG. 3, the case where common inverting driving is done from line to line is now described.

<Color Change is from White to White, Hence there is no Color Change>

In transition from the N'th line to the (N+1)st line, the panel output Sig1 (R), for example, is changed in color from white to white. Since the polarity is inverted between the N'th line and the (N+1)st line, the source line S1 needs to be charged. Hence, the recovery switch 1 (recovery switch 110) is transiently turned on and the source line S1 is connected to the recovery capacitor 112. The source line S1 (display panel load) is charged from the recovery capacitor 112. Then the recovery switch 1 (recovery switch 110) is then turned off by the control signal 111 from the recovery control circuit 109 and the source line S1 is charged from the source buffer 108. Meanwhile, as long as the recovery switch 1 (recovery switch 110) is on, the output of the source buffer 108 of the source line S1 is in a HI-Z state.

<There is Color Change from White to Black or from Black to White>

During transition from the N'th line to the (N+1)st line, the panel output Sig2 (R), for example, is changed in color from black to white. Since there is no change in the output voltage, there is no necessity for charging/discharging the source line S2. Hence, no recovery operation is performed.

<Color is Changed from Black to Black, hence there is no Color Change>

During transition from the N'th line to the (N+1)st line, the panel output Sig2 (G), for example, is changed in color from black to black. At this time, the discharge operation from the source line S2 is required. For this reason, the recovery switch 2 (recovery switch 110) is transiently turned to connect the source line S2 to the recovery capacitor 112 and the recovery capacitor 112 is charged from the source line S2 (panel load). The recovery switch 2 (recovery switch 110) is turned off by the control signal 111 from the recovery control circuit 109 and the source line is discharged by the source buffer 108. Meanwhile, as long as the recovery switch is on, the output of the source buffer 108 of the source line S1 is in a HI-Z state.

It is seen from above that, in the line-based common inverting driving, the recovery operation may be carried out efficiently by turning on the recovery switch 110 only when there is no change in color data, such as in case of color change from white (data=1) to white (data=1) or from black (data=0) to black (data=0).

Figure 9:
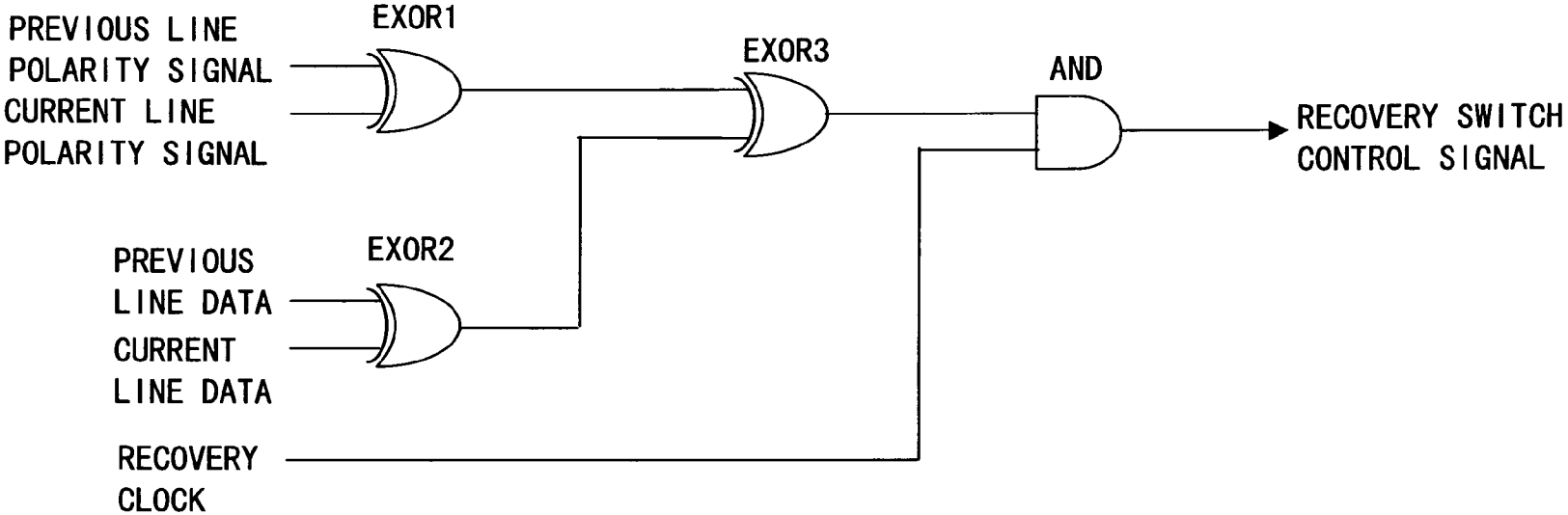
FIG. 9 is a circuit diagram of a recovery control circuit in the example of the present invention.

FIG. 9 shows an illustrative configuration of the recovery control circuit 109 of FIG. 1. Referring to FIG. 9, the recovery control circuit 109 includes an EXOR1, an EXOR2, an EXOR3 and an AND circuit. The EXOR1 takes an Exclusive-OR of the previous line polarity signal and the current line polarity signal. The EXOR2 takes an Exclusive-OR of the previous line data and the current line data. The EXOR3 takes an Exclusive-OR of outputs of the EXOR1 and the EXOR2. The AND circuit takes a logical product of the recovery clock and the output of the EXOR3 to output the resulting signal as the recovery switch control signal (111 of FIG. 1). When the previous line polarity signal is not coincident with the current line polarity signal and the previous line data is coincident with the current line data, the recovery switch control signal becomes HIGH by the recovery clock. When the previous line polarity signal is coincident with the current line polarity signal and the previous line data is not coincident with the current line data, the recovery switch control signal becomes HIGH by the recovery clock.

Figure 4A:
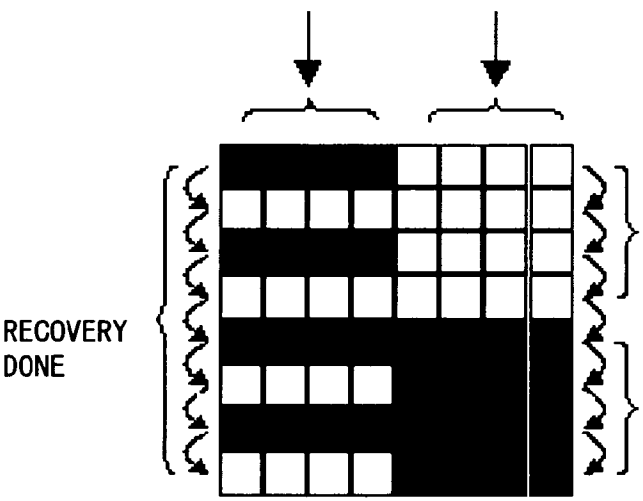
CONVENTIONAL ART FIG. 4A
FIGS. 4A and 4B are schematic views for illustrating the present invention in comparison with the related art (Patent Documents 1 and 2).
Figure 4B:
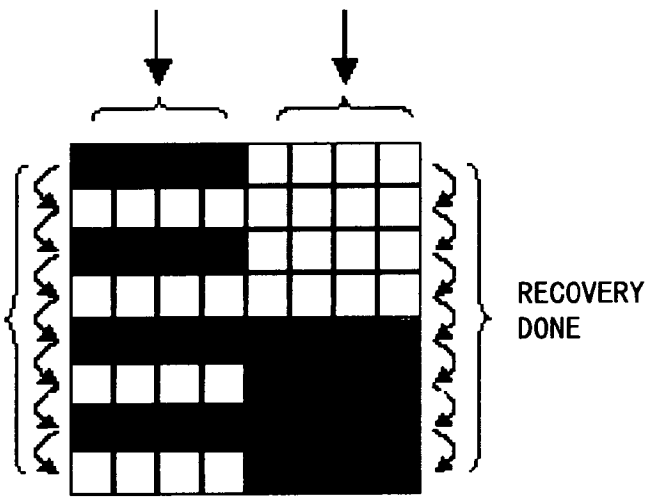

FIGS. 4A and 4B illustrate the operation and the meritorious effect of the present invention in comparison with those of the related art (Patent Documents 1 and 2). In FIGS. 4A and 4B, the left half part is border representation, the right upper part is white all-over representation and the right lower part is black all-over representation. The driving method is frame-based common inverting driving.

FIG. 4A stands for an LCD screen according to the present example in which the recovery operation may be made responsive to data change. It is verified whether or not the recovery operation is to be carried out, from the polarity signals and from changes in data (color data), thus allowing a charge recovery operation optimum for color changes.

In the related art method, shown in FIG. 4B, charge recovery is carried out at all times from line to line. Hence, even though the recovery operation is optimum for the left half part for border representation, charges for pixels for-the right half part, which are not changed in color and hence are not in need of charge recovery, are also recovered. Since charge recovery takes place when the source voltage does not have to be changed, there result the wasteful current consumption and hence the lowered recovery efficiency.

Although FIGS. 4A and 4B show the case of frame-based inverting driving, the same may be said of the case of line-based inverting driving.

Figure 5A:
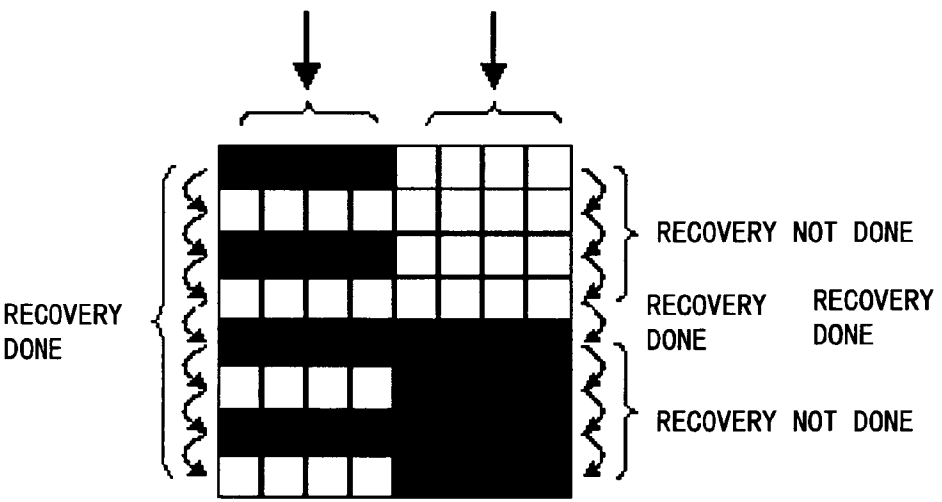
CONVENTIONAL ART FIG. 5A
FIGS. 5A and 5B are schematic views for illustrating the present invention in comparison with the related art (Patent Document 3).
Figure 5B:
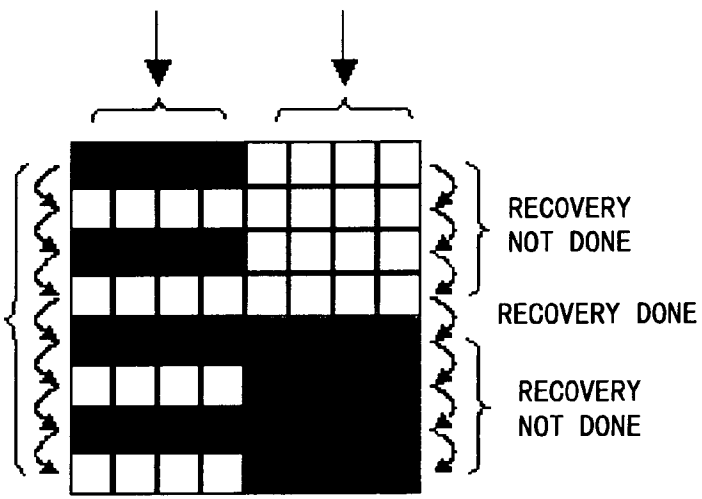

FIGS. 5A and 5B illustrate the operation and the meritorious effect of the present invention in comparison with those of the related art (Patent Document 3). The driving system for this case is the frame-based common inverting driving. In FIG. 5A for the present invention and FIG. 5B for the related art, charge recovery takes place responsive to data change. However, the present invention is improved in the recovery efficiency over the related art (Patent Document 3) in the following respects.

According to the present invention, the number of times of connection to the external capacitor (charge recovery) is smaller than with the related art. Specifically, the connection to the external capacitor takes place once in the present invention, while it takes place twice in the related art. Hence, the present invention may be used with advantage for writing a plural number of times. For example, in writing three times, the number of times of connection is 1×3=3, in the present invention, while that in the related art is 2×3=6.

The operation as well as the meritorious effect may not be demonstrated with the Patent Document 3 except for the case of frame inverting. In contrast, the charge recovery efficiency may be achieved in case of line-based inverting with the present invention, as hereinafter described.

Figure 6A:
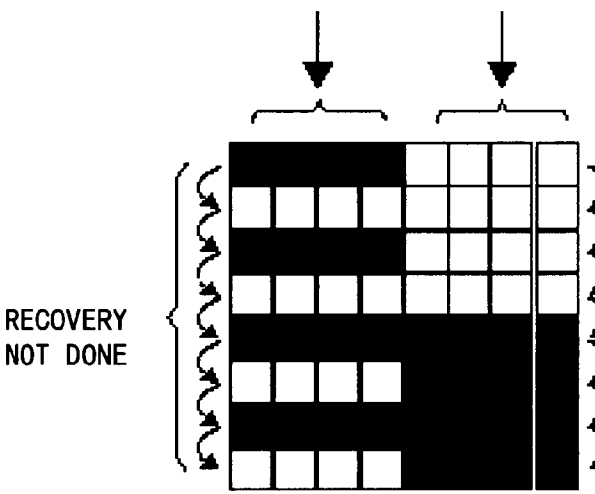
CONVENTIONAL ART FIG. 6A
FIGS. 6A and 6B are schematic views, similar to FIGS. 5A and 5B, for illustrating the present invention in comparison with the related art (Patent Document 3).
Figure 6B:
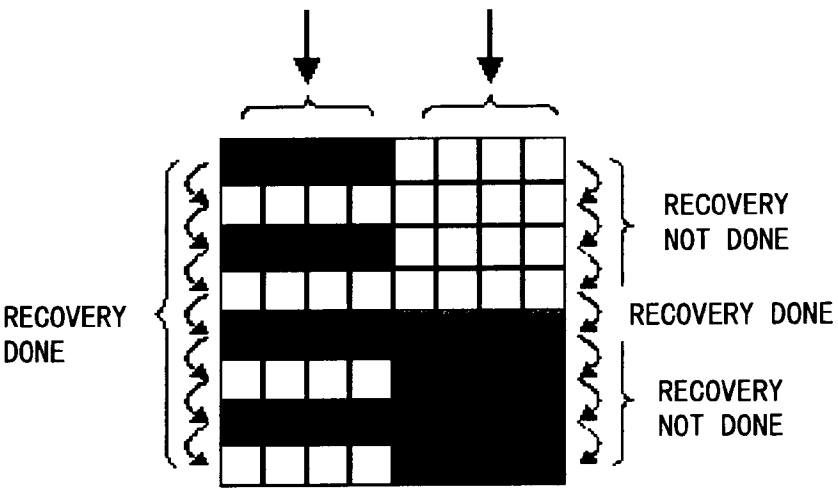

FIGS. 6A and 6B illustrate the operation and the meritorious effect of the present invention in comparison with those of the related art (Patent Document 3) for the case of the line-based common inverting driving. In FIG. 6A for the present invention, the charge recovery may be made in accordance with the polarity signal and data change. The related art (Patent Document 3) shown in FIG. 6B recovers charge in accordance with data change, however, the polarity change is not taken into account, so that, for the left half of the drawing for border representation, charge recovery is line-based. Hence, the recovery operation is not optimum, leading to increased current.

It is assumed that the left half part is border representation, the right upper part is white all-over representation and the right lower part is black all-over representation. In case the driving method is line-based common inverting driving, it is necessary to carry out the recovery operation only in case there is no color change in one picture image. This results because the line polarity is changed, even if the color is changed from line to line, and hence there is no necessity to change the data line voltage. According to the present invention, in which decision on whether or not the charge is to be recovered is given based on the polarity signal and the color data, the charge recovery operation may be optimum for color change.

The operation of the Patent Document 3, shown in FIG. 6B, is the opposite of that of the present invention shown in FIG. 6A, because the Patent Document 3 fails to take account of the polarity signal which is reversed from one line to the next. For this reason, the current reducing effect by charge recovery may not be achieved, with the result that current consumption is increased due to excess current. Even though the Patent Document 3 may be applied to a method using frame-based common inverting driving, or to a method not using common inverting driving, it is not suited to a method using line-based common inverting driving.

In contrast, according to the present invention, an optimum recovering operation may be achieved for any driving method.

Figure 7:
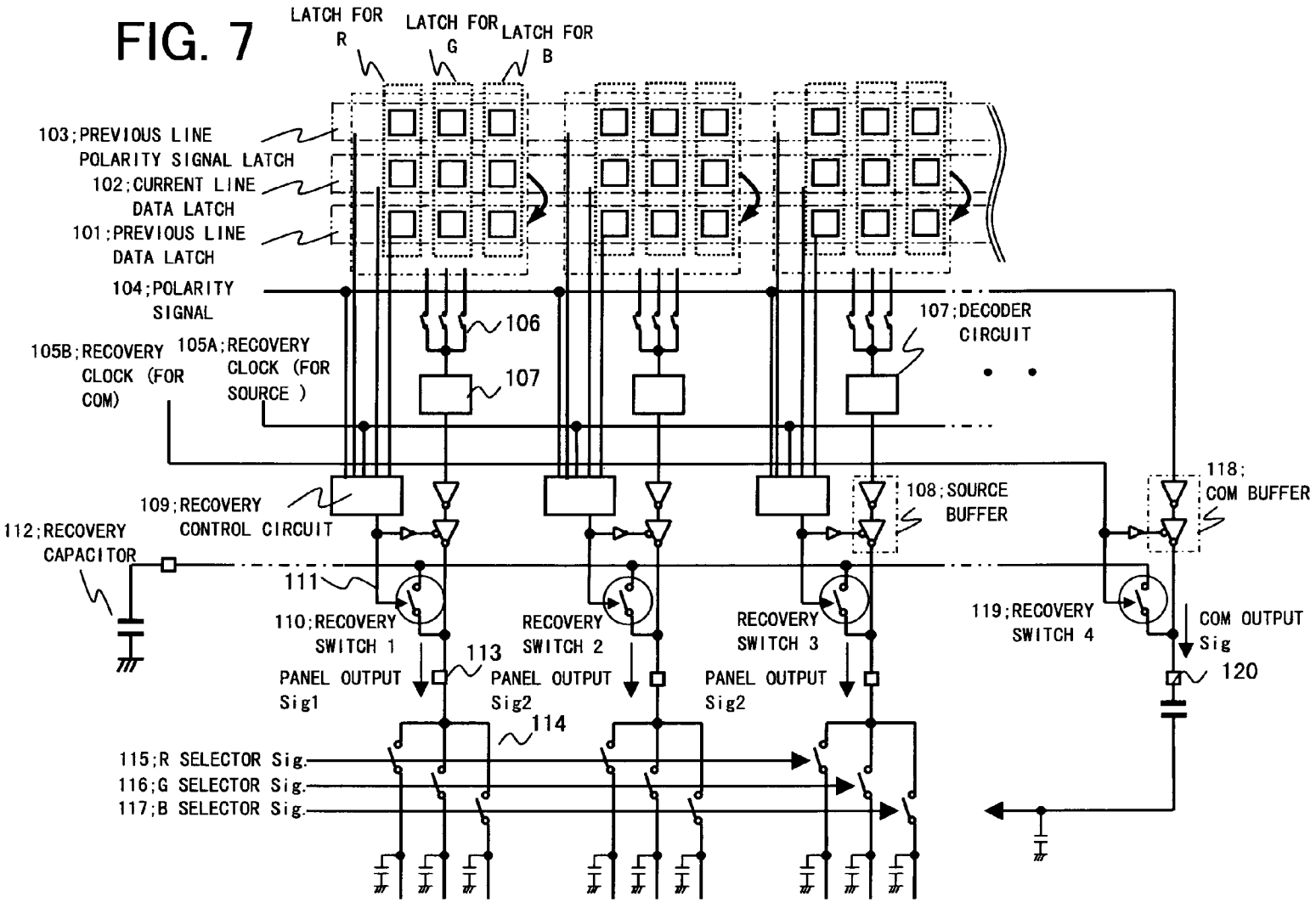
FIG. 7 is a circuit diagram showing a modification of the present invention.

A modification of the present invention is now described with reference to FIG. 7, showing a circuit configuration including a COM buffer.

Figure 8:
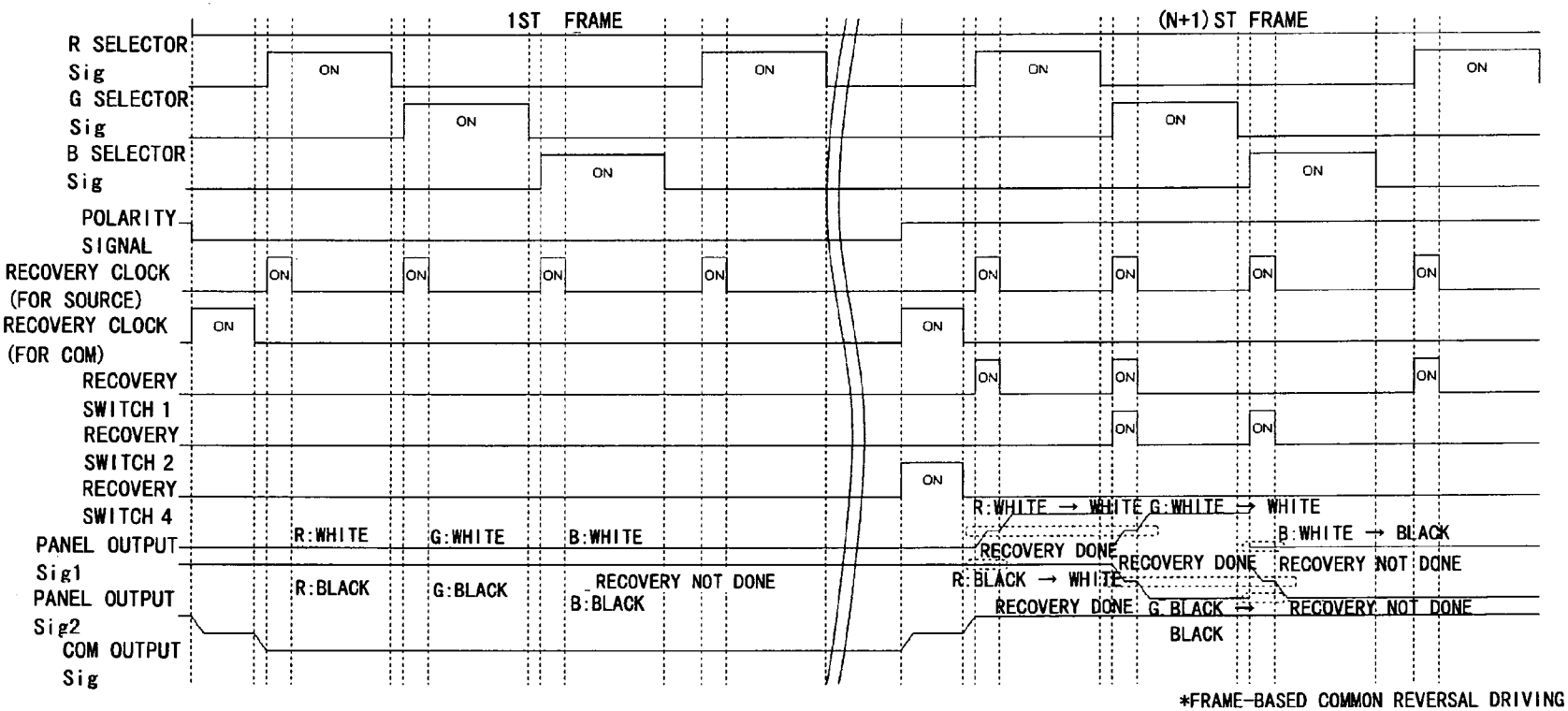
FIG. 8 is a timing waveform diagram for illustrating the operation of the modification of the present invention.

In many cases, a display control driver has mounted thereon a COM buffer 118 in addition to a source output. In the present example, the charge on the COM output may also be recovered to the recovery capacitor 112 by turning the recovery switch 4 (recovery switch 119) on by a recovery clock for COM 105B. FIG. 8 is a timing chart for illustrating the operation of the modification of the present invention shown in FIG. 7. Towards the beginning end of the frame, the recovery clock for COM 105B is activated to turn on the recovery switch 4 (recovery switch 119) to recover charge on the COMMON electrode (COM output Sig). With the recovery switch 4 (recovery switch 119) on, the output of the COM buffer 118 is HI-Z. With the recovery switch 4 (recovery switch 119) off, the COM output Sig is driven by the COM buffer 118.

In the above examples, decision on recovery or non-recovery is given depending on data change and the polarity, such as to achieve a more efficient recovery operation and reduced power dissipation. The charge recovery of the present example may conveniently be carried out for 8-color mode such as for stand-by mode.

The recovery control circuit 109 detects changes in the previous line data and the current line data based on a preset upper bit(s) of the RGB data. The preset upper bit(s) may be plural bits as counted from the MSB (Most Significant Bit) or the MSB bit (sole bit).

In the above-described examples, it is assumed that charge recovered from the source line to the recovery capacitor 112 is to be re-used on the source line. The present invention is not restricted to this configuration and charge stored in the recovery capacitor 112 may, of course, be re-used for other circuits.

In the above-described examples, the case of an 8-color mode for R, G and B has been described. The present invention may, of course, be applied to other than the color display.

This application is based upon and claims the benefit of priority from Japanese patent application No. 2006-183655, filed on Jul. 03, 2006, the disclosure of which is incorporated herein in its entirety by reference. Each disclosure of the above mentioned Patent Documents is incorporated herein in its entirety by reference.

Although the present invention has so far been described with reference to examples, the present invention is not to be restricted to the examples. It is to be appreciated that those skilled in the art can change or modify the examples without departing from the scope and spirit of the invention.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A display control apparatus comprising:

a recovery switch that controls connection and non-connection between an output node of a buffer which drives and outputs data to a pixel on a display panel and a capacitor for recovery of charge; and a recovery control circuit that on/off controls said recovery switch, based on data and a polarity signal of a current line and data and a polarity signal of a previous line.

2. A display apparatus comprising said display control apparatus as set forth in claim 1 and a display panel.

3. A mobile terminal including said display apparatus as set forth in claim 2.

4. A display control apparatus comprising:

a recovery switch that is on/off controlled by a control signal to connect a source line to a recovery capacitor when said recovery switch is on;

a circuit that holds data of a current line, data of a previous line and a polarity signal of said previous line; and a recovery control circuit that generates and supplies said control signal which on/off controls said recovery switch, based on the combination of data of the current line, data of the previous line, a polarity signal of the previous line, a polarity signal of the current line and the value of a recovery clock received.

5. The display control apparatus according to claim 4, wherein said recovery control circuit determines the change in said previous data and the current data using an upper order bit or bits of said data.

6. The display control apparatus according to claim 4, wherein said previous data and the current data are 1-bit data for each of R, G and B colors.

7. The display control apparatus according to claim 6, wherein said recovery control circuit determines the change in said previous data and the current data using said 1-bit data.

8. The display control apparatus according to claim 4, further comprising:

another recovery switch that on/off controls the connection between an output of a buffer which drives a common electrode of a display panel and said recovery capacitor based on another input recovery clock.

9. The display control apparatus according to claim 4, comprising:

a source buffer that drives said source line, said source buffer including a tristate buffer which, based on the control signal from said recovery control circuit, has an output set to a high impedance state and to an output enable state, when said recovery switch is on and off, respectively.

10. The display control apparatus according to claim 4, wherein said recovery control circuit includes:

a first logic circuit that receives data of the previous line and data of the current line, outputs a first value responsive to coincidence between said data of the previous line and the data of the current line, and outputs a second value responsive to non-coincidence between said data of the previous line and the data of the current line;

a second logic circuit that receives a polarity signal of said previous line and a polarity signal of said current line, outputs a first value responsive to coincidence between said polarity signal of said previous line and said polarity signal of said current line and outputs a second value responsive to non-coincidence between said polarity signal of said previous line and said polarity signal of said current line;

a third logic circuit that receives an output of said first logic circuit and an output of said second logic circuit, outputs a first value responsive to coincidence between outputs of said first and second logic circuits and outputs a second value responsive to non-coincidence between said outputs of said first and second logic circuits; and a fourth logic circuit that receives the recover clock and an output of said third logic circuit and outputs said recovery clock as said control signal when an output of said third logic circuit is of said second value.

11. A method for controlling driving in a display device, comprising:

generating a control signal which is for on/off controlling a recovery switch, based on data and a polarity signal of a current line and data and a polarity signal of a previous line; and said recovery switch on/off controlled by said control signal, controlling connection and non-connection between an output node of a buffer for driving and outputting data to a display panel and a recovery for recovering charge on said output node.

12. The method according to claim 11, comprising:

holding data of a current line, data of a previous line and a polarity signal of said previous line; and on/off controlling said recovery switch, based on the combination of the data of the current line, data of the previous line, the value of the polarity signal of the current line, and the value of the polarity signal of the previous line and the value of a recovery clock received.

13. The method according to claim 11, comprising:

determining the change in said previous data and the current data using an upper order bit or bits of said data.

14. The method according to claim 11, wherein said previous data and the current data are 1-bit data for each of R, G and B colors.

* * * * *